United States Patent [19]

Lipschutz

[11] 4,328,693

[45] May 11, 1982

[54] ELECTRICALLY ACTUATED LOCK

[75] Inventor: Paul Lipschutz, Croissy, France

[73] Assignee: Neiman S.A., Courbevoie, France

[21] Appl. No.: 39,976

[22] Filed: May 17, 1979

[30] Foreign Application Priority Data

Jun. 8, 1978 [FR] France ..... 78 17253

[51] Int. Cl.[3] ..... E05B 17/00

[52] U.S. Cl. ..... 70/431; 70/447

[58] Field of Search ..... 70/423, 431, 416, 447

[56] References Cited

U.S. PATENT DOCUMENTS

| | | | |
|---|---|---|---|
| 3,267,707 | 8/1966 | Adams | 70/423 |
| 3,479,850 | 11/1969 | Frye | 70/447 |
| 3,765,199 | 10/1973 | Wiczer | 70/423 |
| 4,064,721 | 12/1977 | Morgan | 70/416 |

*Primary Examiner*—Robert L. Wolfe

*Attorney, Agent, or Firm*—James C. Wray

[57] ABSTRACT

The present invention relates to an electrically actuated lock of the type comprising a rotor pivoting in a body and capable of being locked in relation to the said body by locking members constituted by pairs of opposed pistons or by keepers. The locking members are displaced by notches of a key, coded to permit the rotation of the rotor by action upon the key head. In this invention the unlocking of the rotor is effected by electric means without any opening of the rotor to the external environment, thus ensuring perfect sealing and inviolability. The lock comprises a key shank provided with coded notches, the shank being connected in translation with the movable armature of an electro-magnet, the rotor being provided with a graspable head by means of which the user can rotate the rotor when unlocked by the key.

1 Claim, 1 Drawing Figure

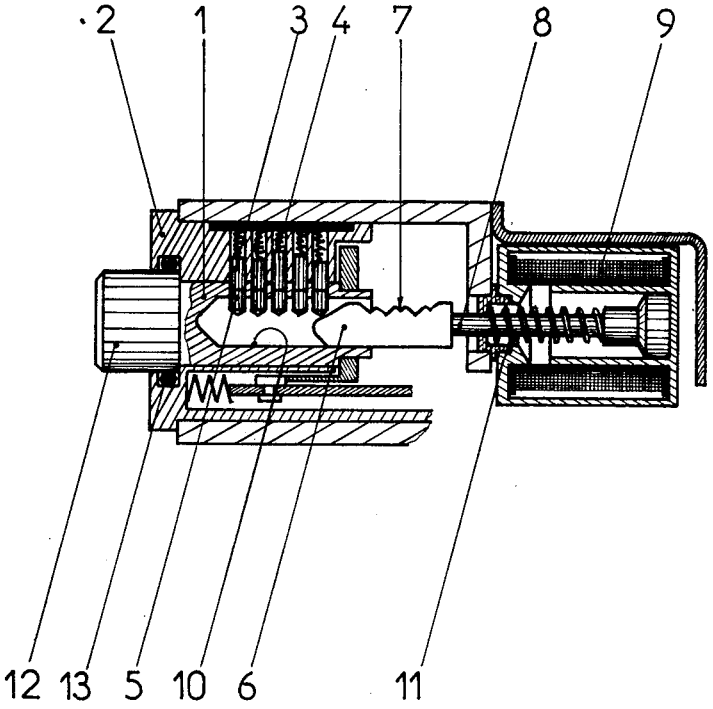
2
1
3
4
7
8
9
12
13
5
10
6
11

ELECTRICALLY ACTUATED LOCK

BACKGROUND OF THE INVENTION

The present invention relates to an electrically actuated lock of the type comprising a rotor pivoting in a body and capable of being locked in relation to the said body by locking members constituted by pairs of opposed pistons or by keepers.

Usually the locking members are displaced by the notches of a key coded to permit the rotation of the rotor by action upon the key head.

OBJECT OF THE INVENTION

The present invention proposes arranging such a lock in such manner that the unlocking of the rotor is effected by electric means without any opening of the rotor to the external environment, thus ensuring perfect sealing and inviolability.

SUMMARY OF THE INVENTION

To this end in accordance with the invention the lock comprises a key shank provided with coded notches and connected in translation with the movable armature of an electro-magnet, the rotor being provided with a graspable head.

BRIEF DESCRIPTION OF DRAWING

The invention will be clearly understood on reading of the following description given with reference to the accompanying drawing in which the single FIGURE is a diagrammatic view in axial section of a lock according to one example of embodiment of the invention.

DESCRIPTION OF THE PREFERRED EMBODIMENT

The lock comprises a rotor 1 pivoting in a fixed body 2. Pistons 3 of the body 2, thrust by springs 4, co-operate with pistons 5 of the rotor 1 to lock the rotor in relation to the body 2, in the absence of a key shank 6 equipped with notches 7 which align the junction zones of the pairs of pistons 3–5 with the periphery of the rotor 1. The key shank 6 is connected in translation with the movable armature 8 of an electro-magnet 9. If the electro-magnet is not energised, the key shank 6 is returned out of the key passage 10 of the rotor 1 by a spring 11. If the electro-magnet is energised the armature 8 shifts, driving the key shank 6 into the passage 10. The rotor 1 is equipped with a graspable head 12 permitting its drive in rotation, and with a packing 13 permitting of ensuring a good seal.

I claim:

1. In a lock mechanism comprising a body, a rotor rotably mounted within a bore formed in said body and being operatively connected with a movable lock piston and movable between a locking position and an opening position, said body having a key-receiving slot formed axially therein, the provision of:

(a) a plurality of locking members in the form of pairs of opposed pistons mounted within aligned bores in said body and said rotor, (b) a key shank provided with coded notches, movable into said key-receiving slot, (c) an electromagnet having an armature connected to said key shank for axial movement thereof to bring the latter into and out of engagement with said locking members, and (d) a head provided on said rotor and extending from said lock, which head is manually rotatable when said key shank is in engagement with said locking members.

* * * * *